US005096272A

United States Patent [19]

Belokin, Jr. et al.

[11] Patent Number: 5,096,272

[45] Date of Patent: Mar. 17, 1992

[54] ADJUSTABLE WIDTH DISPLAY SHELF

[75] Inventors: Paul Belokin, Jr.; Martin P. Belokin; Norman P. Belokin, all of Denton, Tex.

[73] Assignee: Martin Paul, Inc., Denton, Tex.

[21] Appl. No.: 618,932

[22] Filed: Nov. 28, 1990

[51] Int. Cl.[5] ..... A47F 3/06

[52] U.S. Cl. ..... 312/129; 312/321.5; 211/90

[58] Field of Search ..... 211/90, 201, 87; 312/321.5, 214, 129, 130

[56] References Cited

U.S. PATENT DOCUMENTS

| | | | |
|---|---|---|---|
| 1,904,067 | 4/1933 | McGehee | 211/87 |
| 2,826,471 | 3/1958 | Fonda | 312/321.5 |
| 3,129,819 | 4/1964 | Chandler | 211/90 |
| 4,375,268 | 3/1983 | Speck | 211/87 |

*Primary Examiner*—Kenneth J. Dorner
*Assistant Examiner*—Gerald A. Anderson
*Attorney, Agent, or Firm*—Nilles & Nilles

[57] ABSTRACT

An adjustable width display shelf is provided that can be detachably mounted on the inside surface of a transparent door panel. The display shelf includes first and second separate shelf units each including a horizontal shelf for supporting products. Each of the horizontal shelves has a relieved area providing a variable width horizontal hand access opening. A product retainer wall is provided on each of the shelf units having a generally vertically extending inner periphery with the inner peripheries being in opposed spaced facing relation to each other to define a variable width vertical product access opening. An interconnect structure is provided to permit moving the shelf units toward and away from each other to adjust overall width and includes a guide on one of the shelf units and a guideway on the other of the shelf units for adjustably receiving the guide means. An attachment means is mounted on the shelf units for detachably securing the shelf units to the inside surface of a door panel.

18 Claims, 3 Drawing Sheets

ADJUSTABLE WIDTH DISPLAY SHELF

FIELD OF THE INVENTION

This invention relates to a product display shelf adapted to be detachably secured to the surface of a transparent panel of a display cabinet and more specifically to such a shelf that can be adjusted in width.

DESCRIPTION OF THE RELATED ART

Product point-of-sale display cabinets such as coolers and freezers are in widespread use. Such cabinets include an access door having a transparent panel through which products on interior shelves inside the cabinets can be viewed. There exists an unused interior dead space between the inside surface of the door panel and the interior shelves. This interior dead space is normally unused and yet is sufficiently deep to accommodate smaller size packages of convenience foods as, for example, candy bars. These packages come in a wide variety of widths and brands.

There are several requirements that merchants and product manufacturers desire a product display shelf to meet. The merchants' requirements are to: lower costs by having a single shelf that will serve to display products of differing widths while efficiently utilizing the dead space; securely retain products of all sizes on the shelf against accidental dislodging due to inertia forces created by opening and closing the door; achieve simple and quick removal of the shelf from the door panel; easily adjust the shelf width to accommodate different product sizes and space requirements; and have a means to secure the shelf against accidental changes in adjusted width even when removed from the door.

The manufacturer desires: a shelf that will display its products separately from competing products so as to maximize the visual impact of massed brand names; a convenient way to prominently display the product brand name even when all of the products have been sold and removed from the shelf; and a convenient low cost way to provide for change of the product brand name identification on the shelf when the product displayed on the shelf is changed.

The design of display shelves is an extremely old art and an enormously wide variety of types and styles of display shelves exist. However, the prior art does not provide a shelf that: meets the above requirements; is low in cost to manufacture; is strong and durable in use; is convenient to remove; is convenient to adjust in width; and is releasably fastened at the selected width in a manner which will allow the width to be subsequently readjusted.

SUMMARY OF THE INVENTION

In accordance with the present invention, an adjustable width display shelf is provided that can be detachably mounted on the inside surface of a transparent door panel. The display shelf includes first and second separate shelf units each including a horizontal shelf means for supporting products. An interconnect means is provided to permit moving the shelf units toward and away from each other to adjust overall width and includes a guide means on one of the shelf units and a guideway means on the other of the shelf units for adjustably receiving the guide means. The display shelf is also provided with an attachment means mounted on the shelf units for detachably securing the shelf units to the inside surface of a door panel.

Preferably the horizontal shelf means of each shelf unit will have interfacing ends, each of which has a relieved area. The relieved areas confront each other to define a variable width horizontal access opening for a customer's hand that extends from an outer edge of the shelf means toward an inner edge thereof. A product retainer means is also provided on each of the shelf units and extends above the horizontal shelf means. Each retainer means has a generally vertically extending inner periphery with the inner peripheries being in opposed spaced facing relation to each other to define a variable width vertical product access opening for a customer's hand. The display shelf may also include a back wall means and a releasable fastening means for securing the first and second shelf units at any selected overall width. Preferably the releasable fastening means will include a detent assembly comprising a plurality of spaced apart catch elements coactable with a latch element on the back wall means. The releasable fastening means may also include a locking means which is releasably fastened between the shelf units to prevent relative movement from any selected position of width adjustment.

BRIEF DESCRIPTION OF THE DRAWINGS

Referring to the drawings.

BRIEF DESCRIPTION OF THE PREFERRED EMBODIMENT

Figure 1:
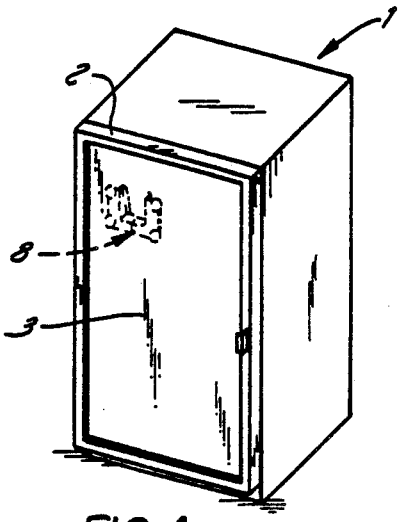
FIG. 1 is an isometric projection of a display cabinet having a transparent door panel on which the adjustable width display shelf constructed according to the present invention is mounted.
Figure 2:
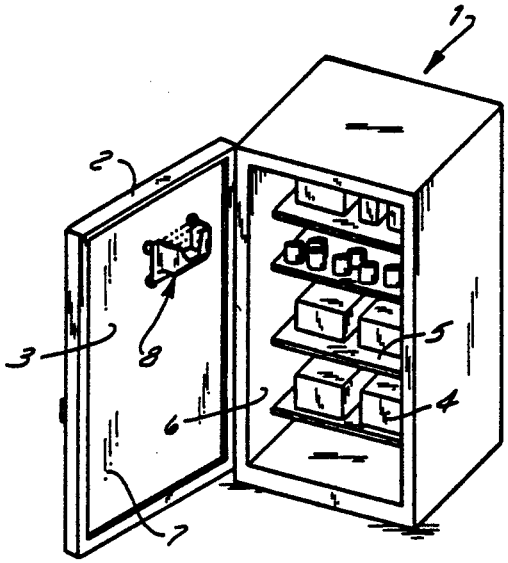
FIG. 2 is a view of the display cabinet shown in FIG. 1 with the door thereof in an open position to more clearly show the adjustable width product display shelf mounted on the inner surface thereof.

FIGS. 1 and 2 show a display cabinet 1 such as a point-of-sale cooler or freezer which has a hinged door 2 having a transparent panel 3 through which customers can view products 4 placed on conventional shelves 5 in the cooler cabinet. The doors 2 can be opened to permit the customers to remove the products 4. The construction of such cabinets is normally such that when the door 2 is closed there is an interior dead space 6 between the inner surface 7 of the door panel 3 and the shelves 5. As shown in FIG. 2, an adjustable width display shelf 8 is shown detachably mounted on the inner surface 7 of the door panel 3 to extend into the interior dead space 6.

Figure 3:
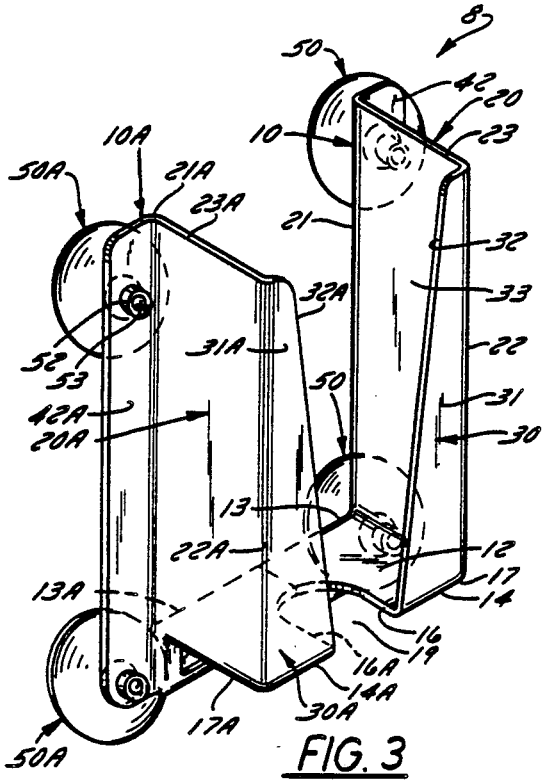
FIG. 3 is an isometric projection view of the front of the adjustable width display shelf.
Figure 4:
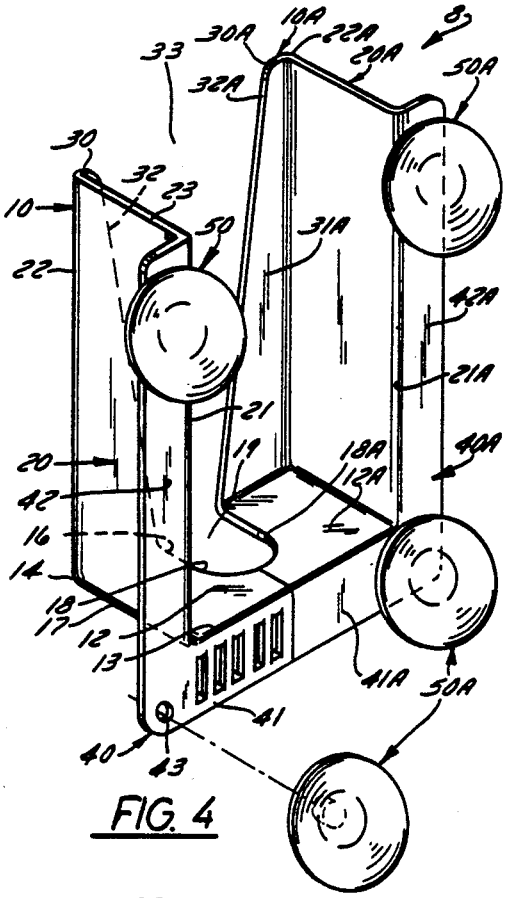
FIG. 4 is an isometric projection view of the rear of the adjustable display shelf shown in FIG. 3.
Figure 10:
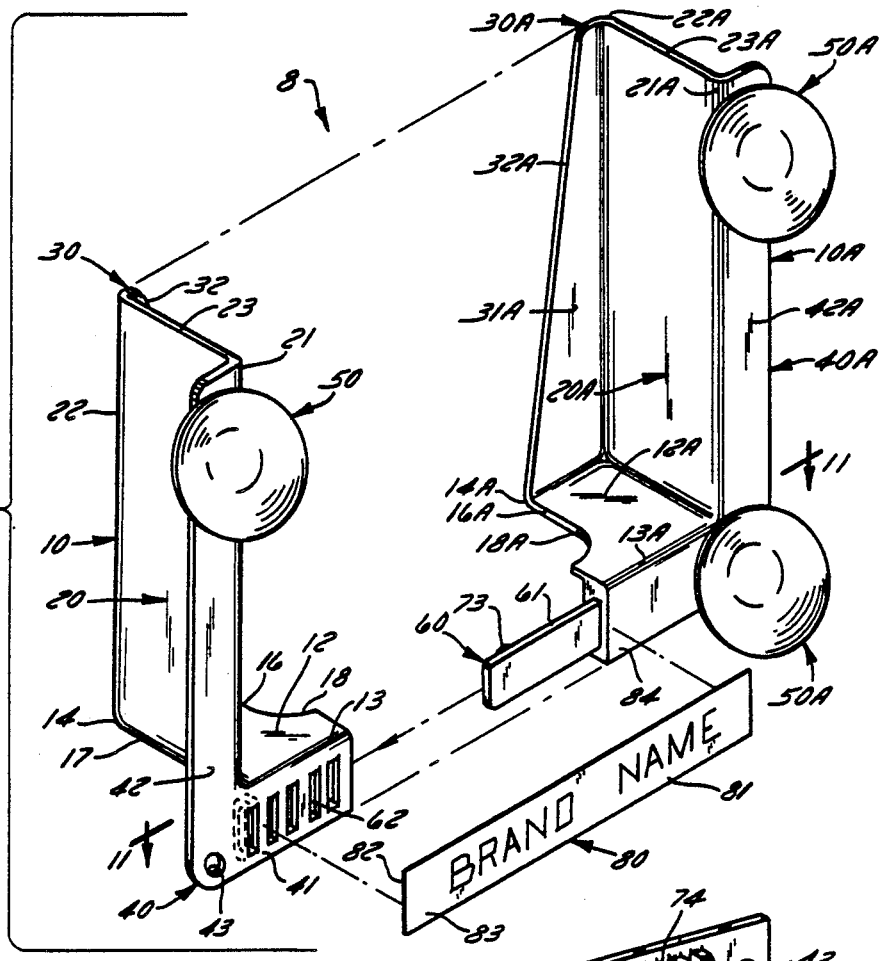
FIG. 10 an isometric projection exploded view of the variable width display shelf.
Figure 8:
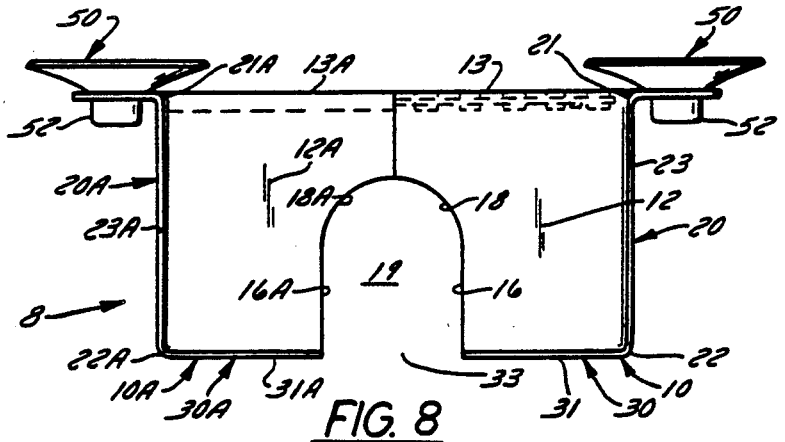
FIG. 8 is a top view of the display shelf.

Referring to the drawings and particularly FIGS. 3, 4 and 10, the product display shelf 8 comprises first and second separate shelf units 10 and 10A. The shelf unit 10 includes a shelf means 12 for supporting products. The shelf means 12 has spaced apart inner and outer edges 13, 14, an inner facing end 16 and an outer end 17. The shelf unit 10A is similar in construction and includes a horizontal shelf means 12A having an inner edge 13A and outer edge 14A, an inner facing end 16A and an outer end 17A. As best shown in FIGS. 4 and 8, the horizontal shelf means 12, 12A each has a relieved area 18, 18A in the interfacing ends 16, 16A, respectively. The relieved areas 18, 18A are in confronting relation to each other and coact to define a variable width horizontal product access opening 19 that provides a breach in the outer edges 14, 14A through which the fingers of a customer's hand may be conveniently inserted in order to place products on the shelf or remove products from the shelf.

The shelf unit 10 includes an end wall 20 which extends vertically above the outer end 17 of the shelf means 12. In similar manner, the shelf unit 10A has an end wall 20A extending vertically from the outer end 17A of the shelf means 12A. The end walls 20, 20A have inner and outer vertical margins 21, 22, 21A, 22A and top margins 23, 23A. The end walls 20, 20A may be formed integrally with the shelf means 12 and 12A or may be constructed separately and joined thereto by any suitable means.

Each of the shelf units 10, 10A is provided with a retainer means 30, 30A. The product retainer means 30 for shelf unit 10 includes a retainer wall 31 which extends vertically above the outer edge 14 of the shelf means 12 and terminates at the top margin 23 of the end wall 20. Similarly the retainer means 30A for the shelf unit 10A comprises a retainer wall 31A which extends from the outer edge 14A of the shelf unit 10A and terminates at the top margin 23A of the end wall 20A.

The retainer walls 31, 31A have inner peripheries 32, 32A which are in opposed facing relation to each other to define a vertical product access opening 33 which is in general alignment above the horizontal product access opening 19. Preferably the inner peripheries 32, 32A will taper, as shown, to provide a vertical product access opening which is wider at the top of the display shelf and narrower at the bottom thereof in order to more conveniently guide the customer's hand in removing products which are on or closely adjacent to the shelf means 12, 12A. The retainer walls 31, 31A may be formed integral with the outer vertical margins 22, 22A of the end walls 20, 20A and the outer edges 14, 14A of the shelf means 12, 12A.

Figure 7:
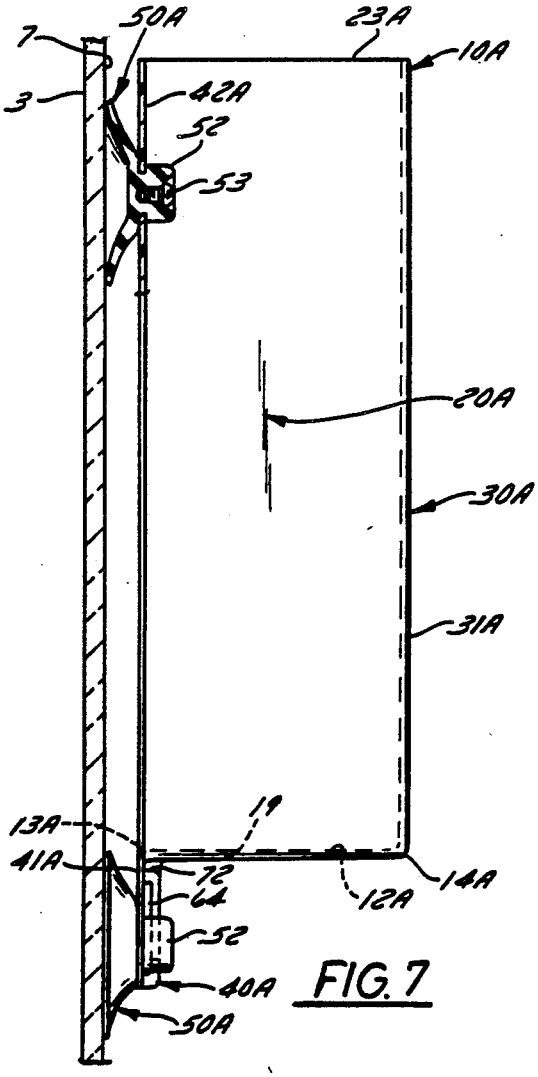
FIG. 7 is a side elevational view of the display shelf partially in section taken along line 7—7 of FIG. 6.
Figure 9:
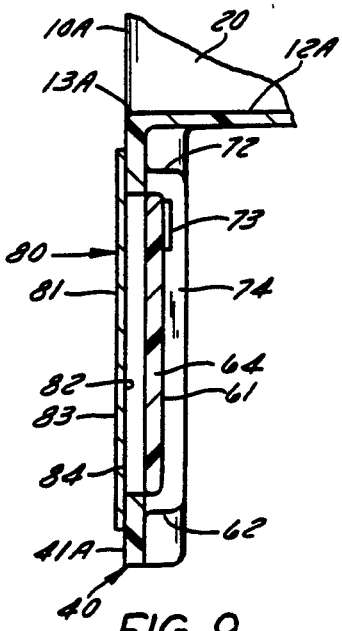
FIG. 9 is a partial sectional view taken along line 9—9 of FIG. 5.

Display shelf 1 is also provided with a back wall means 40, 40A on each of the shelf units 10, 10A, respectively. The back wall means 40 comprises a first flange member 41 which depends from the inner edge 13 of the shelf means 12 and a second flange member 42 connected to the inner vertical margin 21 of the end wall 20 to extend vertically coextensive therewith. Similarly the back wall means 40A includes a first flange 41A which depends from the inner edge 13A of the shelf means 12A and a second flange 42A which is connected to the inner margin 21A of the end wall 20A to extend vertically coextensive therewith. The back wall means 40, 40A are provided with suitable apertures 43, 43A (FIG. 11) which receive an attachment means 50, 50A for detachably securing the display shelf to the inside surface of the door panel. The attachment means comprises four suction type attachment cups, each of which includes an enlarged hub 52 (FIG. 7) insertable through the apertures 43, 43A. The suction cups may be releasably locked in place by means of an expansion screw 53 which is releasably threaded into the hub to expand it and releasably secure it in its respective aperture 43, 43A.

Figure 11:
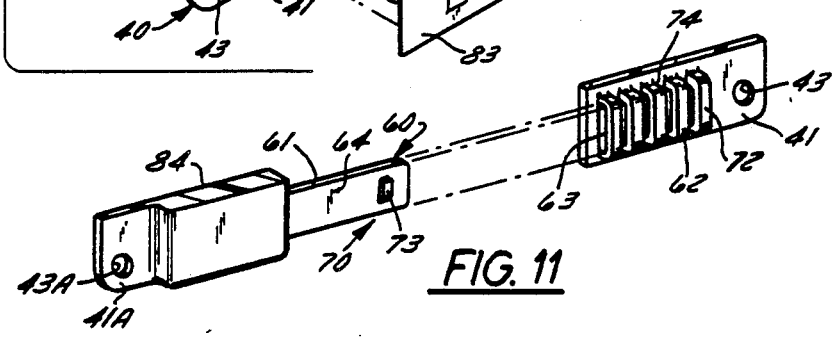
FIG. 11 is an isometric projection partial sectional view taken along line 11—11 of FIG. 10.

An interconnect means 60, best seen in FIGS. 10 and 11, is provided for mounting the first and second shelf units 10, 10A for movement toward or away from each other in order to permit the overall width of the display shelf 8 to be adjusted to any predetermined dimension. The interconnect means 60 includes a guide means 61 on one of the shelf units 10A and a guideway means 62 on the other of the shelf units 10. The guideway means 62 comprises a channel element 63 which is mounted on the first flange 41 and the guide means 61 includes a tongue element 64 mounted on first flange member 41A.

The display shelf further includes a fastening means 70 for securing the first and second shelf units 10, 10A at any selected overall width. The fastening means 70 includes a releasable detent assembly that comprises a plurality of catch elements 72 on first flange member 41A and a latch element 73 mounted on first flange member 41. Latch element 73 is engageable with any one of the catch elements 72 to releasably fasten the shelf units 10, 10A in one position of selected adjustment. As best shown in FIG. 11, latch element 73 comprises a transverse projection on the end of tongue element 64. The catch elements comprise a plurality of spaced apart individual U-shaped portions which also project transversely out from the first flange member 41. U-shaped portions are in alignment with each other to define the channel 63 for receiving the tongue element 64. The U-shaped portions are spaced apart a distance 74 that will permit latch element 73 to project therebetween. The U-shaped portions may be made of a deflectable material such as plastic which will allow them to stretch slightly in order to permit the easy passage of the latch element 73. If desired, the latch element 73 could be constructed to resiliently depress within the body of the tongue 64.

Figure 5:
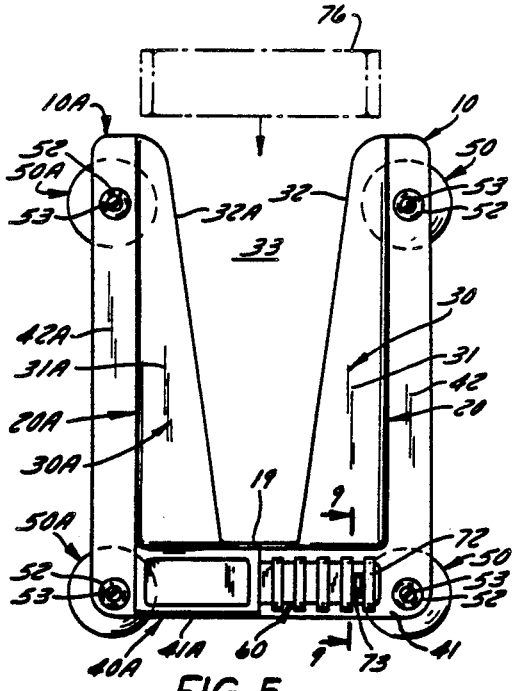
FIG. 5 a front elevational view of the adjustable width display shelf shown in FIGS. 3 and 4 at its narrow width adjustment.
Figure 6:
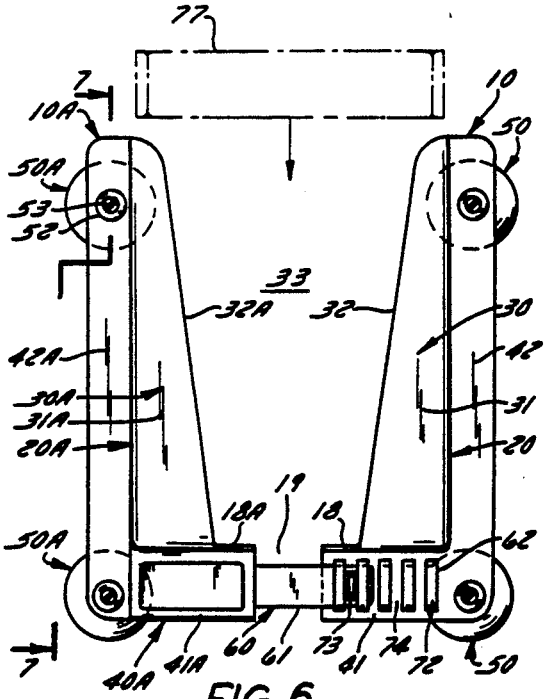
FIG. 6 is a front elevational view of the adjustable width display shelf shown in FIGS. 3 and 4 adjusted to its widest width.

The shelf units 10, 10A can be easily assembled into an integrated variable width display shelf simply by inserted tongue 64 into the channel 63 and moving the units toward each other until the desired width of shelf is achieved. The shelf can be adjusted to accommodate products of varying widths as, for example, the small and large width candy bars 76, 77 shown in FIGS. 5 and 6. It is common for candy bars to come in regular and large sizes, and a display shelf constructed in accordance with the present invention can be quickly and simply adjusted in width to accommodate whatever size candy bar is desired to be displayed on the inside of the cooler door panel 3. As shown in FIG. 5, the shelf units 10, 10A are positioned close to each other to receive a candy bar 76 of small overall width. If desired, the shelf units 10, 10A may be moved away from each other to the position as shown in FIG. 6 wherein a candy bar 77 of greater overall width can be received on the shelf.

The shelf units 10, 10A may be locked in any overall preselected width by a locking means 80. Preferably the locking means will comprise a flexible locking strip 81 having inner and outer sides 82, 83. The inner side 82 is provided with a releasable adhesive so that the locking strip may be placed against the inner surfaces 84 of the back wall first flange members 41, 41A to hold the shelf units 10, 10A in a predetermined position of adjustment. Preferably the locking strip 81 will be marked with the brand name of the product that is contained by the display shelf. A product supplier providing a merchant with a plurality of different size products containing different brand names may also provide a plurality of preprinted locking strips with different brand names thereon corresponding to the products ordered. When the merchant changes the product on the display shelf 1, the locking strip 81 may be removed, the shelf units 10, 10A adjusted to the new required width, and a new locking strip applied containing a brand name which identifies the product now being displayed on the display shelf. The outer side 83 of the locking strip faces the inner surface 7 of the door panel 3 and can be readily viewed by customers approaching the display cabinet.

Preferably the shelf means 12, 12A, end wall means 20, 20A, retainer means 30, 30A, and back wall means 40, 40A are each molded into one integral piece of transparent plastic material so as to provide a clear field of view of the products contained in the shelf. In addition, the guide means 61 can be integrally molded onto one of the shelf units 10A, and the guideway means 62 be integrally molded onto the other of the shelf units 10. The locking strip 81 can be made out of a nontransparent material so that when it is applied it conceals the interconnect means, thus making the installed display shelf more aesthetic as well as highlighting the brand name of the product displayed.

What is claimed is:

1. An adjustable width display shelf for a point-of-sale cabinet of the type that includes a transparent door panel having an inside surface, said display shelf being detachably mountable on said inside surface and comprising:

first and second separate shelf units each including a shelf means for supporting products that has spaced apart inner and outer edges, an interfacing end, and an outer end;

an interconnect means for mounting said first and second shelf units with said interfacing ends in opposed facing relation for movement toward or away from each other to permit the overall width of said display shelf to be adjusted to any predetermined width, said interconnect means including, a guide means on one of said shelf units projecting toward the other of said shelf units when they are in said facing relation, a guideway means on the other of said shelf units dimensioned to slidably receive said projecting guide means, and said guide means and guideway means interconnecting said first and second shelf units to hold them as an integrated freestanding assembly at any predetermined width; and an attachment means mounted on said shelf units for detachably securing the latter to said inside surface of the door panels.

2. The display shelf according to claim 1 further comprising:

said interfacing ends of said shelf means each having a relieved area with said relieved areas being in confronting relation to each other and coacting to define a variable width horizontal product access opening extending from said outer edge toward said inner edge; and first and second product retainer means on each of said shelf units extending vertically above said outer edge of each of said respective shelf means, said retainer means each having a generally vertically extending inner periphery with said inner peripheries being in opposed spaced facing relation to each other to define a variable width vertical product access opening.

3. The display shelf according to claim 1 wherein said first and second shelf units each includes first and second end walls each extending vertically from said outer ends of said first and second shelf means, respectively.

4. The display shelf according to claim 1 further comprising a releasably fastening means on the first and second shelf units for securing them at any selected overall width.

5. The display shelf according to claim 1 further comprising first and second back wall means on said first and second shelf units, respectively.

6. The display shelf according to claim 5 wherein said attachment means comprise suction type attachment means secured to said first and second back wall means.

7. The display shelf according to claim 5 wherein said first and second back wall means each includes a first flange member depending vertically from said inner edge of said first and second shelf means;

said guide way means includes a channel element mounted on one of said first flange members; and said guide means includes a tongue element mounted on the other of said first flange members to slidably extend into said channel member.

8. The display shelf according to claim 7 wherein said first and second shelf units each includes first and second end walls each extending vertically from said outer ends of said first and second shelf means, respectively, each of said end walls having inner and outer vertical margins; and said first and second back wall means each further includes a second vertical flange member connected to said inner vertical margin of said first and second end walls, respectively.

9. The display shelf according to claim 8 further comprising a fastening means for securing said first and second shelf units at any selected overall width, said fastening means including a releasable detent assembly comprising a plurality of spaced apart catch elements on one of said first flange members and a latch element on the other of said first flange members for engagement with any one of said catch elements to releasably fasten said shelf units in any one position of adjustment that has been selected.

10. The display shelf according to claim 9 wherein said fastening means further includes a locking means releasably fastened between said shelf units to prevent relative movement of said shelf units from said one position of adjustment after said detent assembly has been engaged.

11. The display shelf according to claim 9 wherein said plurality catch elements comprise individual U-shaped portions which project transversely outward from the first flange member on which they are mounted with said U-shaped portions being aligned with each other to define said channel element for receiving said tongue element therein.

12. An adjustable width display shelf for a point-of-sale cabinet of the type that includes a transparent door panel having an inside surface, said display shelf being detachably mountable on said inside surface and comprising:

first and second separate shelf units each having a shelf means for supporting products that includes spaced apart inner and outer edges, an interfacing end, and an outer end;

an end wall extending vertically from each of said outer ends of said shelf means and having inner and outer vertical margins;

a product retainer means extending vertically above said outer edges of each of said shelf means;

a back wall means on each of said shelf units including a first flange member depending from said inner edge of each of said shelf means, respectively, and a second flange member connected to said inner margin of each of said end walls to extend vertically thereof;

an interconnect means for mounting said first and second shelf units with said interfacing ends in opposed facing relation for movement toward or away from each other to permit the overall breath of said display shelf to be adjusted to any predetermined width, said interconnect means including, a guide means on one of said shelf means projecting toward the other of said shelf units when in said facing relation, a guideway means on the other of said shelf means dimensioned to slidably receive said projecting guide means, and said guide means and guideway means interconnecting said first and second shelf units to hold them as in integrated freestanding assembly at any predetermined width; and an attachment means mounted on each said shelf units for detachably securing the latter to said inside surface of the door panel.

13. The adjustable width display shelf according to claim 12 wherein said guide means includes a tongue element on one of said first flange members and said guideway means includes a channel element means on the other of said first flange members for slidably receiving said tongue element therein.

14. The display shelf according to claim 12 further comprising said interfacing ends of said shelf means each having a relieved area with said relieved areas being in confronting relation to each other and coacting to define a variable width horizontal product access opening that provides a breach in the outer edge of said shelf means.

15. The display shelf according to claim 14 wherein said product retainer means includes a wall extending vertically upward from each of said outer edges of said shelf means, each of said retainer walls having an inner periphery with said inner peripheries being in opposed facing relation to each other to define a vertical product access opening in general alignment with said breach in said outer edges of said shelf means.

16. The display shelf according to claim 12 further comprising a fastening means for securing said first and second shelf units at any selected overall width, said fastening means including a releasable detent assembly comprising a plurality of spaced apart catch elements on one of said shelf units and a latch element on the other of said shelf units for engagement with any one cf said catch elements to releasably fasten said shelf units in any one position of adjustment that has been selected.

17. The display shelf according to claim 16 wherein said fastening means further includes a locking means releasably fastened between said shelf units to prevent relative movement of said shelf units from said one position of adjustment after said detent assembly has been engaged.

18. The display shelf according to claim 16 wherein said plurality of catch elements comprises individual U-shaped portions which project transversely outward from the first flange member on which they are mounted with said U-shaped portions being aligned with each other to define said channel element for receiving said tongue element therein.

* * * * *